US009046312B2

(12) United States Patent
Dieckmann

(10) Patent No.: US 9,046,312 B2
(45) Date of Patent: Jun. 2, 2015

(54) GAS OPERATING SYSTEM FOR A FIREARM

(75) Inventor: Ralf Eckehart Dieckmann, Prescott, AZ (US)

(73) Assignee: MCMILLAN GROUP INTERNATIONAL, LLC, Phoenix, AZ (US)

( * ) Notice: Subject to any disclaimer, the term of this patent is extended or adjusted under 35 U.S.C. 154(b) by 568 days.

(21) Appl. No.: 13/068,083

(22) Filed: May 2, 2011

(65) Prior Publication Data

US 2012/0279385 A1 Nov. 8, 2012

(51) Int. Cl.
*F41A 5/00* (2006.01)
*F41A 5/26* (2006.01)

(52) U.S. Cl.
CPC ..... *F41A 5/26* (2013.01)

(58) Field of Classification Search
USPC ..... 89/193, 191.01, 179
See application file for complete search history.

(56) References Cited

U.S. PATENT DOCUMENTS

| | | | | |
|---|---|---|---|---|
| 7,971,518 | B2 * | 7/2011 | Adams | 89/191.01 |
| 8,393,259 | B2 * | 3/2013 | Larue | 89/193 |
| 8,413,571 | B2 * | 4/2013 | Adolphsen | 89/193 |
| 8,561,335 | B2 * | 10/2013 | Brown | 42/71.01 |
| 2006/0065112 | A1 * | 3/2006 | Kuczynko et al. | 89/193 |
| 2007/0012169 | A1 * | 1/2007 | Gussalli Beretta | 89/193 |
| 2009/0120277 | A1 * | 5/2009 | Adams | 89/179 |
| 2010/0101405 | A1 * | 4/2010 | Adams | 89/191.01 |
| 2010/0275770 | A1 * | 11/2010 | Noveske | 89/193 |
| 2011/0271826 | A1 * | 11/2011 | Molinari | 89/193 |
| 2012/0152106 | A1 * | 6/2012 | Langevin | 89/193 |
| 2012/0167756 | A1 * | 7/2012 | Larue | 89/193 |
| 2013/0055883 | A1 * | 3/2013 | Cassels | 89/193 |
| 2013/0098235 | A1 * | 4/2013 | Reinken | 89/193 |

* cited by examiner

*Primary Examiner* — Michelle R Clement
(74) *Attorney, Agent, or Firm* — Bennet K. Langlotz; Langlotz Patent & Trademark Works, Inc.

(57) ABSTRACT

A gas operating system for a firearm has an energy transmission facility and a gun barrel having a lateral aperture. The energy transmission facility and the lateral aperture have gas communication between them. The gun barrel and the energy transmission facility are mechanically decoupled such that the energy transmission facility does not impede flexing of the gun barrel. All forward forces generated by the energy transmission facility may be transferred from the energy transmission facility to a self-loading facility. The energy transmission facility may include a gas block having a sleeve that is slidably disposed on the gun barrel. The energy transmission facility may include a gas block and a tubular body extending from a receiver to the gas block, one end of the tubular body being slidably received in the gas block. The energy transmission facility may also include the tubular body receiving a gas piston.

15 Claims, 4 Drawing Sheets

GAS OPERATING SYSTEM FOR A FIREARM

FIELD OF THE INVENTION

The present invention relates to fully and semi-automatic, magazine fed, gas-operated firearms of the type where the operating gas is obtained from a hole drilled through one wall of the barrel, and more particularly to means for improving the accuracy of such systems.

BACKGROUND OF THE INVENTION

When a rifle is fired, the barrel is observed to "whip" or flex, and the point of impact of the projectile varies depending on the position of the muzzle when the projectile exits. Best precision is achieved when factors are controlled to permit the projectile to exit when the barrel is at a stationary maximum excursion, so that minute variances in projectile exit time have a minimal effect on the point of impact. Such barrel harmonics are relatively predicable in free-float barrels used for precision shooting, typically with bolt actions. However, when gas systems used for self-loading rifles are connected to barrels, the barrel harmonics are greatly complicated, and it is accepted that such systems have inferior accuracy potential relative to other systems, even when optimized.

When a projectile leaves the muzzle of a barrel, the projectile is quickly overtaken by the high pressure gases exiting the muzzle behind the projectile. Therefore, as the projectile speeds away from the muzzle, propellant gases rush continuously past it so the projectile flies in a three dimensional envelope of gas. This effect continues for several feet until the supply of gas from the barrel ceases and the remaining gases slow down and dissipate into the surrounding atmosphere.

Certain mechanical conditions existing in a gas-operated firearm at the instant of discharge cause the muzzle of the barrel to move vertically or laterally after the projectile has cleared the muzzle. The lateral movement of the barrel modulates the column of gas as it leaves the muzzle. Since the velocity of the gas is higher than that of the projectile, the effect of this modulation is carried forward to the moving projectile as the gas passes it, thus influencing the point of impact of the projectile.

If the mechanical conditions of the firearm were the same for each shot fired, then the point of impact of the projectile would also be the same for each shot, and accuracy would not be impaired. However, mechanical conditions vary from shot to shot in a magazine fed, gas-operated firearm.

The majority of prior art gas systems consist of a gas block rigidly attached to the barrel, where the gas block incorporates an integral gas cylinder and a gas piston housed within the gas cylinder. There is also an orifice communicating with the bore of the barrel and the gas cylinder. When such a system is energized with high pressure gas from the bore of the barrel, the gas cylinder and the gas block receive an impulse in the direction of the muzzle which causes the muzzle to be displaced downward when the gas system is located on top of the barrel, and which causes the muzzle to be displaced upward when the gas system is located under the barrel. The degree of displacement of the muzzle is governed by the resistance to motion of the breech mechanism as the gas piston is driven rearward. When a full magazine is inserted into the firearm, the cartridges press against the underside of the breech mechanism, and the resistance to motion of the breech mechanism is high, decreasing with each shot as the magazine is emptied. Because of the principle of Newton's Third Law of Motion, the gas block receives a greater impulse when the magazine is full than it receives with an almost empty magazine.

Other factors that can cause the impulse received by the gas block to vary are when firing the firearm in a downhill or an uphill attitude, where the mass of the breech mechanism would be a factor.

Still another factor that can cause the impulse received by the gas block to vary is found in firearms of the M-1 Garand, M-14, or Ruger Mini-14 type. These firearms all employ the same type of rotating breech bolt. The breech bolt has a smooth polished underside on its left and a V-notch underside on its right. The purpose of the V-notch is to clear the right magazine lip when the breech bolt rotates to the locked position.

In a double column, two-position feed magazine, cartridges pushing against the V-notch underside of the breech bolt cause considerably more resistance to rotation during the unlocking of the breech bolt than cartridges pushing against the left underside of the breech bolt. This difference in resistance to rotation reflects back into the impulse applied to the gas block. Thus, as cartridges are fed from the magazine, the force they apply to the underside of the breech bolt increases or decreases as cartridges are fed from the right or the left of the magazine and then decreases overall as the magazine is emptied.

Yet another factor that can cause the impulse received by the gas block to vary is caused by variations in the powder charge in the cartridges and variations in the projectile diameter and weight.

From the above it can be seen that for every shot fired from a gas-operated, magazine fed firearm, the muzzle of its barrel receives a lateral impulse which is different for every shot fired. Therefore, the gases issuing from the muzzle send a "pneumatic message" to the projectile as the gases overtake the projectile. This is analogous to the carrier wave in an FM broadcast being modulated by an audio signal.

Bolt action single shot rifles with floating barrels are known for their superior accuracy because the muzzle of the barrel moves repeatably. The cartridge load can be fine tuned to enable the bullet to exit with the barrel in a stationary position at its extreme limit of motion. In contrast, the gas tubes and cylinders of gas-operated firearms resist the whipping, flexing action of the barrel in unpredictable ways, making the firearm less precise.

It is therefore an object of this invention to provide a gas operating system for fully and semiautomatic firearms which does not convey any impulses or other mechanical disturbances to the barrel of a firearm.

SUMMARY OF THE INVENTION

The present invention provides an improved gas operating system for firearms, and overcomes the above-mentioned disadvantages and drawbacks of the prior art. As such, the general purpose of the present invention, which will be described subsequently in greater detail, is to provide an improved gas operating system for firearms that has all the advantages of the prior art mentioned above.

To attain this, the preferred embodiment of the present invention essentially comprises an energy transmission facility and a gun barrel having a lateral aperture. The energy transmission facility and the lateral aperture have gas communication between them. The gun barrel and the energy transmission facility are mechanically decoupled such that the energy transmission facility does not impede flexing of the gun barrel. The energy transmission facility may include a gas block having a sleeve that is slidably disposed on the gun barrel. The energy transmission facility may include a gas block and a tubular body extending from a receiver to the gas block, one end of the tubular body being slidably received in the gas block. The energy transmission facility may also include the tubular body receiving a gas piston. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
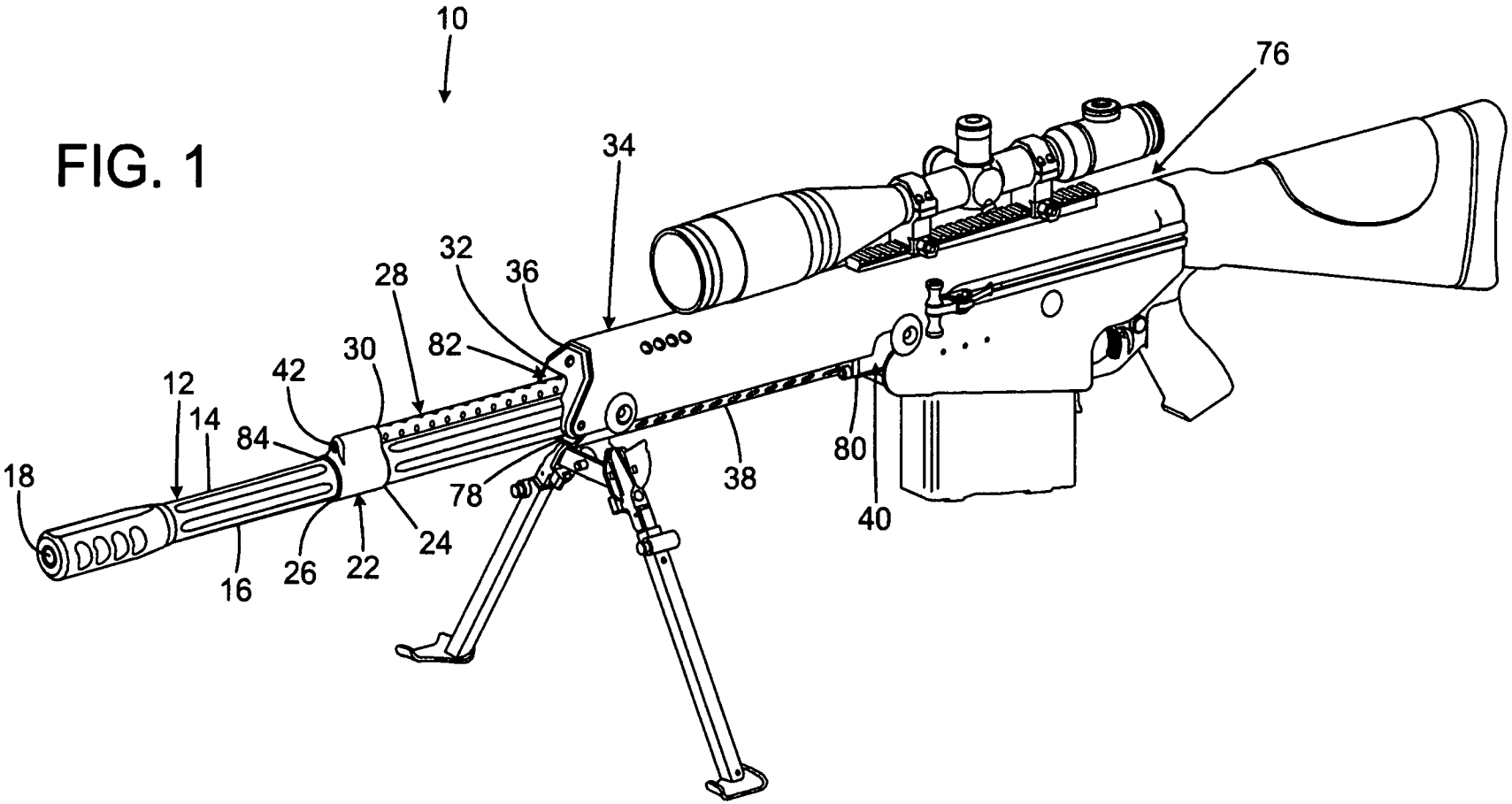
FIG. 1 is a top perspective view of a rifle including a gas operating system for a firearm of the present invention constructed in accordance with the principles of the present invention.

A first embodiment of the gas operating system for a firearm of the present invention is shown and generally designated by the reference numeral 10.

FIG. 1 illustrates a rifle 76 including a gas operating system for a firearm 10 of the present invention. More particularly, the rifle 76 has a breech ring 40, stand-off assembly 38, receiver 34, and barrel 12. The muzzle 18 of the barrel protrudes forwardly from the front 36 of the receiver and the front 78 of the stand-off assembly. The breech ring extends rearwardly from the rear 80 of the stand-off assembly. A gas block 22 has a central bore 84 that slidably receives the barrel. A gas tube guard tube 28 surrounds a gas tube 50 (visible in FIGS. 2A and 2C).

Figure 2A:
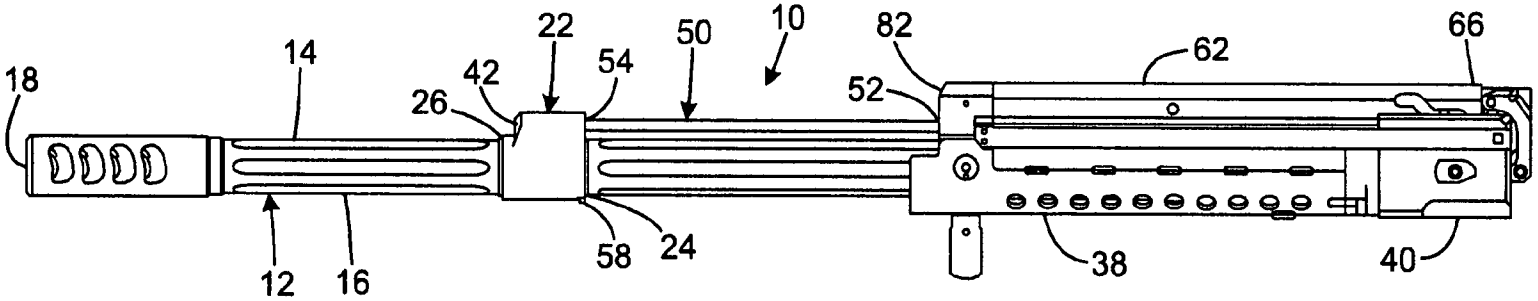
FIG. 2A is a side view of a first embodiment of the gas operating system for a firearm of the present invention.
Figure 2B:
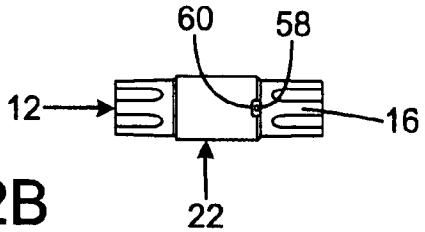
FIG. 2B is a bottom fragmentary view of the gas block mounted on a barrel of the first embodiment of the gas operating system for a firearm of the present invention.
Figure 2C:
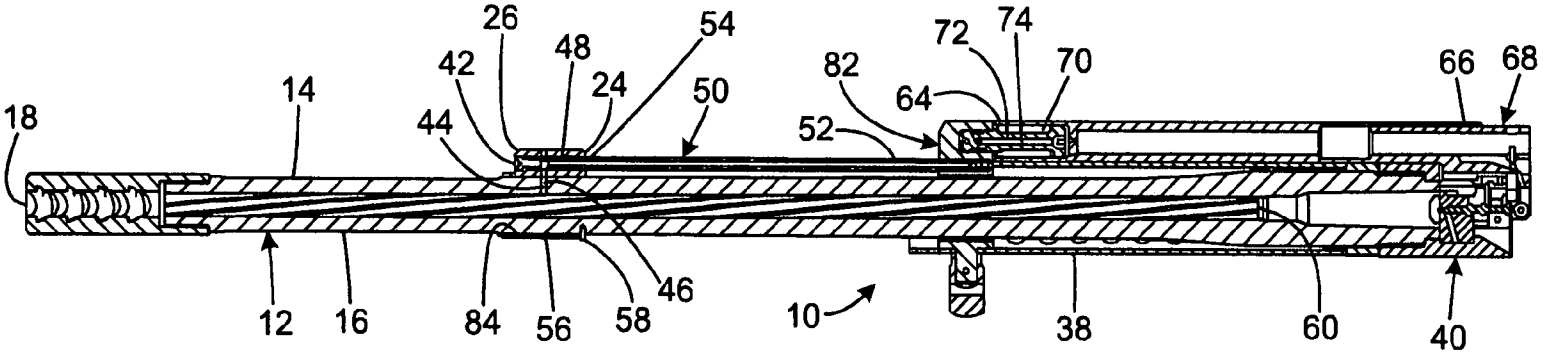
FIG. 2C is a side sectional view of a first embodiment of the gas operating system for a firearm of the present invention.

FIGS. 2A-2C illustrate the first embodiment of the gas operating system for a firearm 10 of the present invention. More particularly, a stop 82 is attached to, and extends forward from, the stand-off assembly. A stationary gas piston 72 is attached to the stop 82 for engagement with a cylindrical bore 70 in the front 64 of the breech block carrier 62. The gas piston seals the front opening of the cylindrical bore so the cylindrical bore acts as a moving gas cylinder. The rear end 52 of the gas tube 50 is rigidly attached to the stop 82 to communicate with the gas piston, while the front end 54 of the gas tube is received within a bore 48 in the rear 24 of the gas block 22. The front of the gas tube is rigidly attached to the gas block by a bolt 42, thus establishing the longitudinal location of the gas block along the length of the barrel. The location of the gas block coincides with a gas orifice 44 in the top 14 of the barrel. The gas block is not rigidly attached to the barrel, but floats instead in a slidable relationship.

When a cartridge is fired within the barrel, pressurized gas from the barrel enters the gas tube via the gas orifice in the barrel and a gas block passage 46 in the gas block. Gas flows rearwardly into a passage 74 in the center of the stationary gas piston, pressurizing the gas cylinder in the front of the carrier. Once a sufficient pressure is reached to overcome the force of a return spring (not shown) that biases the breech block carrier forwardly against the stop 82, the breech block carrier is forced rearwards so its rear 66 can act upon the breech block assembly 68 and cycle the action of the firearm.

Some of the pressurized gas from the barrel escaping through the gas orifice in the barrel is allowed to leak into a small annular space 56 between the gas block and a journal of the barrel. This annular space incorporates a labyrinth seal to minimize gas leakage. A labyrinth seal is composed of many straight grooves in close proximity inside another axle, or inside a hole, so the gas has to pass through a long and difficult path to escape. Sometimes screw threads exist on the outer and inner portion. These interlock to produce the long characteristic path which slows leakage.

At the instant of pressurization, the gas block is separated from the barrel by a thin film of waste gas acting as a gas bearing, so the gas block does not physically contact the barrel. Therefore, the barrel is free to torque (from bullet rotation) and move forward and rearward without any restriction from the gas block or gas tube. Most of the gas operating forces are transferred to the gas piston and subsequently to the stop. The remaining small forces tend to stretch the gas tube in a forward direction. Because the gas block floats upon the barrel, these stretching forces are not transferred from the gas tube to the barrel, making the barrel behave more like the floating barrels of single shot bolt action rifles. Instead, the stretching forces are transferred from the gas tube to the stand-off assembly via the stop.

Although the barrel is free to move forward and rearward with respect to the gas block, FIG. 2B shows how a limit pin 58 extending downwards from the bottom 16 of the barrel limits rotation of the gas block with respect to the barrel. The bottom of the gas block forms a limit pin window 60 that loosely receives the limit pin. The loose fit limits excessive application of torque to the gas block by external forces while simultaneously permitting the user to check that the gas block can freely move on the barrel. Movement of the barrel with respect to the gas block makes the labyrinth seal self-cleaning.

Figure 3A:
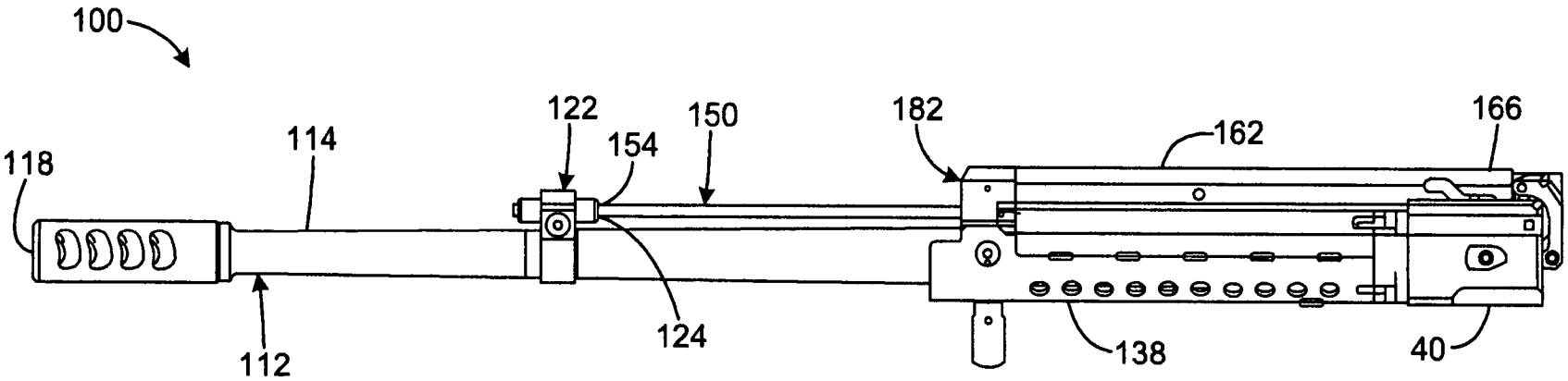
FIG. 3A is a side view of a second embodiment of the gas operating system for a firearm of the present invention.
Figure 3B:
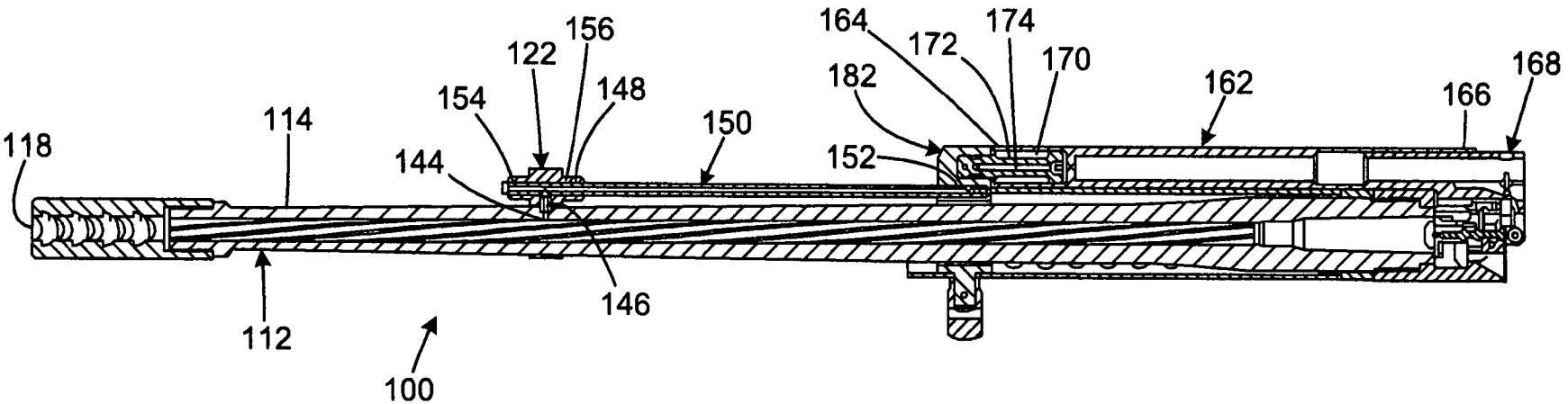
FIG. 3B is a side sectional view of a second embodiment of the gas operating system for a firearm of the present invention.

FIGS. 3A-3B illustrate the second embodiment of the gas operating system for a firearm 100 of the present invention. More particularly, a stop 182 is attached to, and extends forward from, the stand-off assembly 138. A stationary gas piston 172 is attached to the stop for engagement with a cylindrical bore 170 in the front 164 of the breech block carrier 162. The gas piston seals the front opening of the cylindrical bore so the cylindrical bore acts as a moving gas cylinder. The rear end 152 of the gas tube 150 is rigidly attached to the stop 182 to communicate with the gas piston, while the front end 154 of the gas tube is received within a gas cylinder bore 148 extending through the gas block 122. The front end of the gas tube floats within the gas block cylinder in a slidable relationship. A small annular space 156 separates the gas block cylinder from the front end of the gas tube. This small annular space incorporates a labyrinth seal. The gas tube is plugged at its front end. The location of the gas block coincides with a gas orifice 144 in the top 114 of the barrel. The gas block is rigidly attached to the barrel.

When a cartridge is fired within the barrel, pressurized gas from the barrel enters the side of the gas tube through an aperture via the gas orifice in the barrel and a gas block passage 146 in the gas block. Gas flows rearwardly into a passage 174 in the center of the stationary gas piston, pressurizing the gas cylinder in the front of the carrier. Once a sufficient pressure is reached to overcome the force of a return spring (not shown) that biases the breech block carrier forwardly against stop 182, the breech block carrier is forced rearwards so its rear 166 can act upon the breech block assembly 168 and cycle the action of the firearm.

At the instant of pressurization, the gas tube is separated from the gas block by a thin film of gas and does not physically contact the gas block. Therefore, the barrel and the gas block are free to torque and move forward and rearward without any restriction from the gas tube. Most of the gas operating forces are transferred to the gas piston and subsequently to the stop. The remaining small forces tend to stretch the gas tube in a forward direction. Because the gas tube floats within the gas block, these stretching forces are not transferred from the gas tube to the barrel, making the barrel behave more like the floating barrels of single shot bolt action rifles. Instead, the stretching forces are transferred from the gas tube to the stand-off assembly via the stop.

Figure 4A:
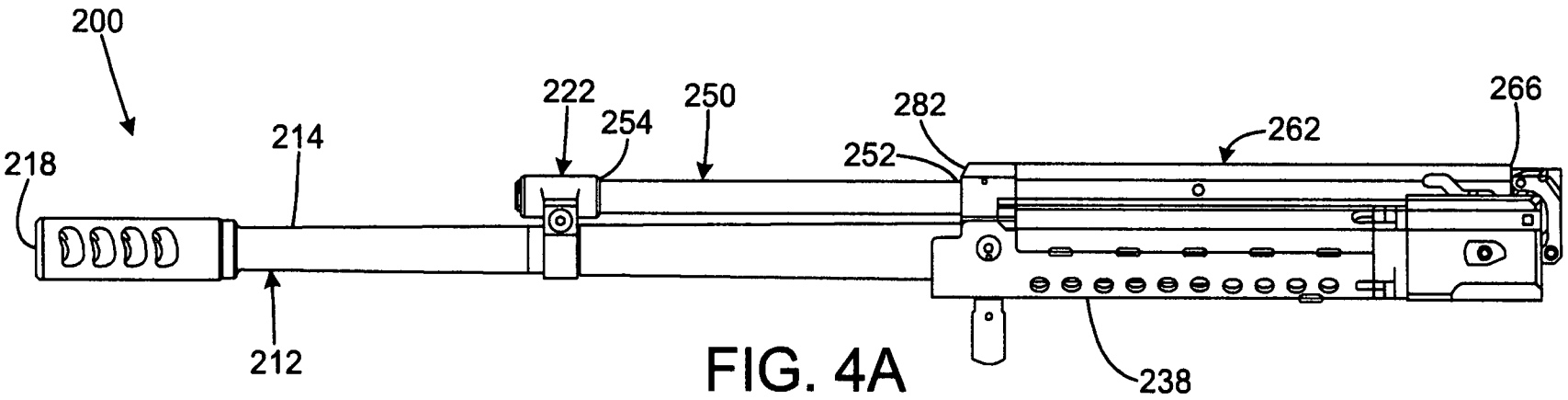
FIG. 4A is a side view of a third embodiment of the gas operating system for a firearm of the present invention.
Figure 4B:
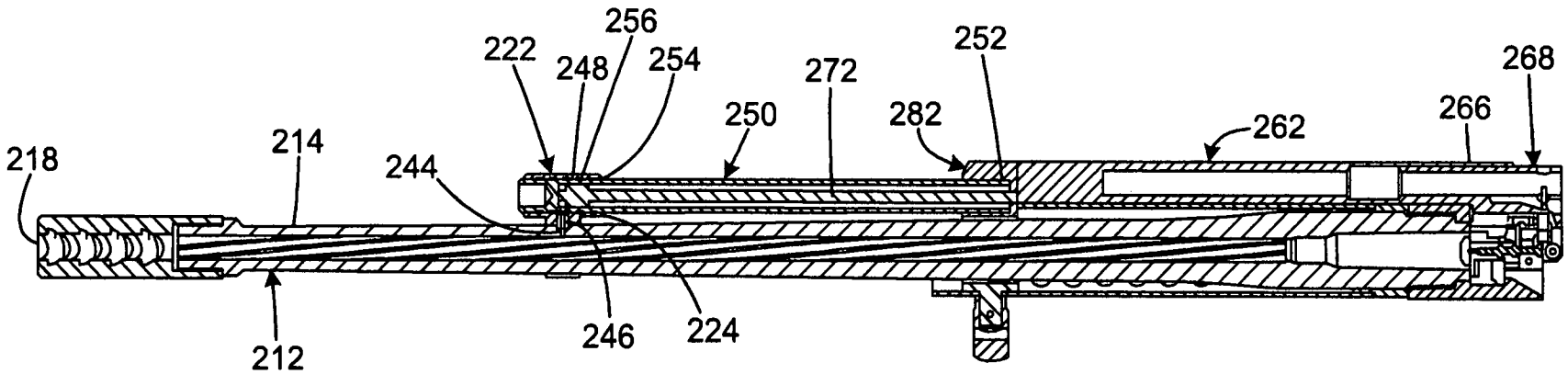
FIG. 4B is a side sectional view of a third embodiment of the gas operating system for a firearm of the present invention.

FIGS. 4A-4B illustrate the third embodiment of the gas operating system for a firearm 200 of the present invention. More particularly, a stop 282 is attached to, and extends forward from, the stand-off assembly 238. The rear end 252 of a gas cylinder 250 is rigidly attached to the stop while the front end 254 of the gas cylinder floats in a cylindrical bore 248 in the gas block 222. The front end of the gas cylinder is plugged. The gas block is rigidly clamped to the barrel 212. The location of the gas block coincides with a gas orifice 244 in the top 214 of the barrel. There is a small annular space 256 between the cylindrical bore in the gas block and the front end of the gas cylinder. This annular space incorporates a labyrinth seal. A gas piston 272 is located inside the gas cylinder.

When a cartridge is fired within the barrel, pressurized gas from the barrel enters the front end of the gas cylinder via the gas orifice in the barrel and a gas block passage 246 in the gas block. Gas flows rearwardly and drives the gas piston rearward. Once a sufficient force is exerted by the gas piston to overcome the force of a return spring (not shown) that biases the breech block carrier forwardly against stop 282, the breech block carrier is forced rearwards so its rear 266 can act upon the breech block assembly 268 and cycle the action of the firearm.

At the instant of pressurization, the gas cylinder is separated from the gas block by a thin film of gas and does not physically contact the gas block. Because of the floating nature of the gas cylinder, no forward forces are transmitted to the gas block and thus to the barrel. Therefore, the barrel is free to torque and move forward and rearward without any restriction from the gas cylinder. Approximately one-half of the gas operating forces are transferred to the gas piston and subsequently to the breech block carrier 262. The other half of the gas operating forces tend to stretch the gas cylinder in a forward direction. Because the gas cylinder floats within the gas block, these stretching forces are not transferred from the gas cylinder to the barrel, making the barrel behave more like the floating barrels of single shot bolt action rifles. Instead, the stretching forces are transferred from the gas cylinder to the stand-off assembly via the stop.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of the gas operating system for a firearm has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A gas operating system for a firearm having a self-loading action comprising:

an energy transmission facility operably connected to the self-loading facility;

a gun barrel having a lateral aperture;

the energy transmission facility being operably connected to the lateral aperture for gas communication;

the gun barrel and the energy transmission facility being mechanically decoupled from each other during operation, such that the energy transmission facility does not impede flexing of the gun barrel during operation;

the energy transmission facility including a gas block; and the gas block having a sleeve that is slidably disposed on the gun barrel.

2. The system of claim 1 wherein the sleeve and the gun barrel have surfaces that are in close but slidable relation, with at least one of the surfaces having a labyrinth seal.

3. The system of claim 2 wherein the labyrinth seal defines a gas area, the gas area forcing a portion of gas from the lateral aperture to pass through a long and difficult path to escape to an ambient area.

4. A gas operating system for a firearm having a self-loading action comprising:

an energy transmission facility operably connected to the self-loading facility;

a gun barrel having a lateral aperture;

the energy transmission facility being operably connected to the lateral aperture for gas communication;

the gun barrel and the energy transmission facility being mechanically decoupled from each other during operation, such that the energy transmission facility does not impede flexing of the gun barrel during operation;

the energy transmission facility including a gas block;

the energy transmission facility including a tubular body extending from a receiver to the gas block; and one end of the tubular body being slidably received in the gas block.

5. The system of claim 4 wherein forward forces generated by the energy transmission facility are transferred from the tubular body to the receiver.

6. The system of claim 4 wherein the tubular body and the gas block bore have surfaces that are in close but slidable relation, with at least one of the surfaces having a labyrinth seal.

7. The system of claim 6 wherein the labyrinth seal defines a gas area, the gas area forcing a portion of gas from the lateral aperture to pass through a long and difficult path to escape to an ambient area.

8. The system of claim 1 further comprising the energy transmission facility including a tubular body extending from a receiver to the gas block;

one end of the tubular body being slidably received in the gas block; and the tubular body receiving a gas piston.

9. The system of claim 8 wherein forward forces generated by the energy transmission facility are transferred from the tubular body to the receiver.

10. The system of claim 8 wherein the tubular body and the gas block bore have surfaces that are in close but slidable relation, with at least one of the surfaces having a labyrinth seal.

11. The system of claim 10 wherein the labyrinth seal defines a gas area, the gas area forcing a portion of gas from the lateral aperture to pass through a long and difficult path to escape to an ambient area.

12. A firearm having a self-loading action, including a gun barrel having a lateral aperture comprising:

an energy transmission facility operably connected to the self-loading facility;

the energy transmission facility being operably connected to the lateral aperture for gas communication;

the energy transmission facility including a gas block;

the gas block having a sleeve that is slidably mounted on the gun barrel; and the gun barrel and the gas block being mechanically decoupled from each other during operation, such that the energy transmission facility does not impede flexing of the gun barrel during operation.

13. The firearm of claim 12 wherein forward forces generated by the energy transmission facility are transferred from the energy transmission facility to the self-loading facility.

14. The firearm of claim 12 wherein the sleeve and the gun barrel have surfaces that are in close but slidable relation, with at least one of the surfaces having a labyrinth seal.

15. The firearm of claim 14 wherein the labyrinth seal defines a gas area, the gas area forcing a portion of gas from the lateral aperture to pass through a long and difficult path to escape to an ambient area.

* * * * *